US009023571B2

(12) United States Patent
Yamada et al.

(10) Patent No.: US 9,023,571 B2
(45) Date of Patent: May 5, 2015

(54) LIQUID DEVELOPER

(71) Applicant: Konica Minolta, Inc., Chiyoda-ku (JP)

(72) Inventors: Chiaki Yamada, Ibaraki (JP); Masahiro Anno, Sakai (JP); Yukiko Uno, Kyoto (JP); Satoshi Matsumoto, Kyoto (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/036,854

(22) Filed: Sep. 25, 2013

(65) Prior Publication Data

US 2014/0087305 A1 Mar. 27, 2014

(30) Foreign Application Priority Data

Sep. 26, 2012 (JP) ..... 2012-212408

(51) Int. Cl.
*G03G 9/12* (2006.01)
*G03G 9/13* (2006.01)

(52) U.S. Cl.
CPC ..... *G03G 9/132* (2013.01); *G03G 9/122* (2013.01)

(58) Field of Classification Search
USPC ..... 430/112, 114, 115
See application file for complete search history.

(56) References Cited

U.S. PATENT DOCUMENTS

2007/0020545 A1* 1/2007 Bossidan et al. ..... 430/108.21
2014/0044461 A1* 2/2014 Miyamoto ..... 399/308

FOREIGN PATENT DOCUMENTS

JP 63-123058 * 5/1988 ..... G03G 9/12
JP 03-054579 * 3/1991 ..... G03G 15/00
JP 2001-159834 A 6/2001
JP 2003-005447 * 1/2003 ..... G03G 9/09
JP 2011-027845 A 2/2011
JP 2011-043650 A 3/2011

OTHER PUBLICATIONS

Translation of abstract of JP 03-054579 published Mar. 1991.*
Translation of JP 2003-005447 published Jan. 2003.*
Translation of abstract of JP 63-123058 published May 1988.*

* cited by examiner

*Primary Examiner* — Peter Vajda
(74) *Attorney, Agent, or Firm* — Buchanan Ingersoll & Rooney PC

(57) ABSTRACT

A liquid developer of the present invention includes a toner particle and an insulating liquid, the toner particle including a resin and a pigment, the resin including a polyester resin, the pigment including a first pigment, a second pigment, and a third pigment, the first pigment being a carbon black, 10 to 25 mass % of the first pigment being included in the toner particle, the second pigment being nigrosine, 3 to 15 mass % of the second pigment being included in the toner particle, the third pigment being at least one organic pigment selected from a group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, 5 to 20 mass % of the third pigment being included in the toner particle.

9 Claims, 1 Drawing Sheet

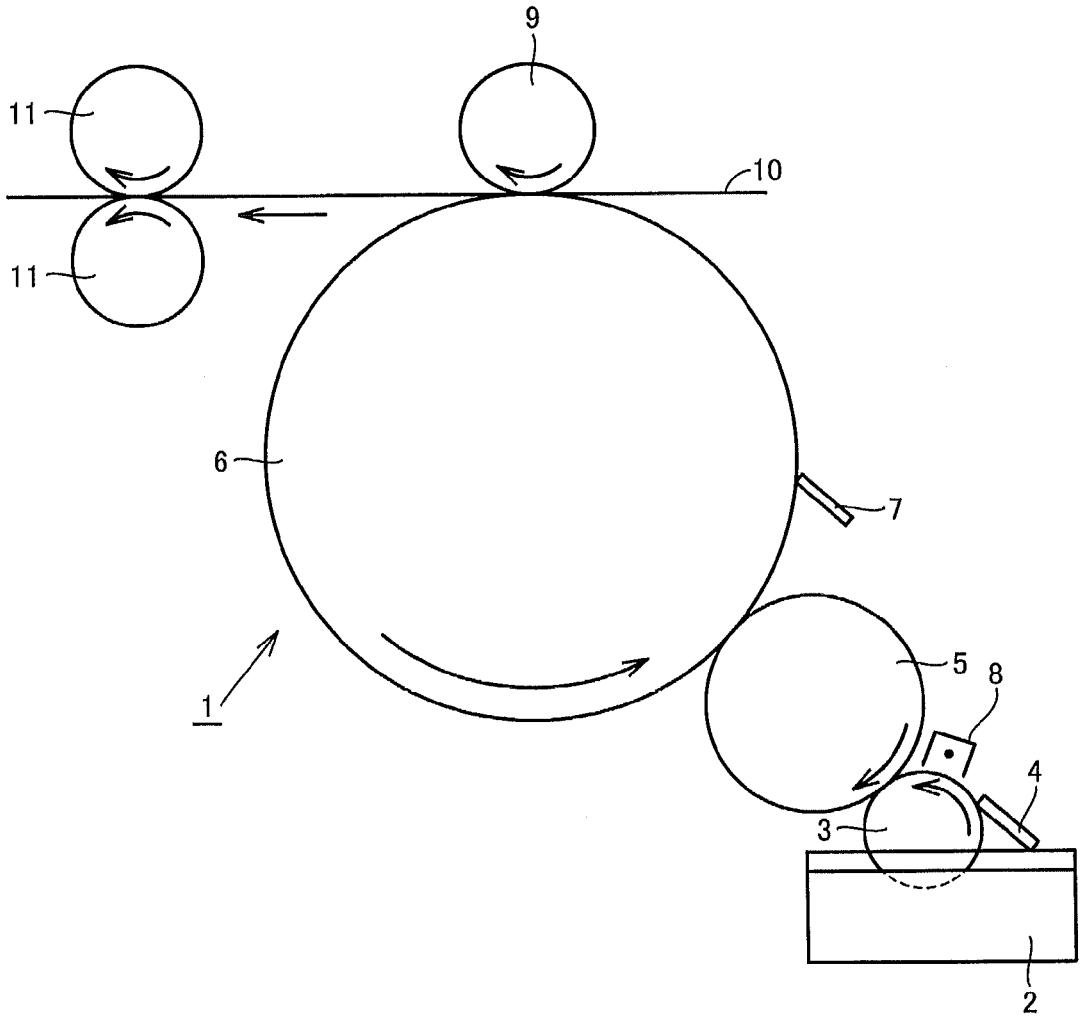
9
11
10
11
6
7
1
5
8
4
3
2

LIQUID DEVELOPER

This application is based on Japanese Patent Application No. 2012-212408 filed with the Japan Patent Office on Sep. 26, 2012, the entire content of which is hereby incorporated by reference.

BACKGROUND OF THE INVENTION

1. Field of the Invention

The present invention relates to a liquid developer.

2. Description of the Related Art

In a general dry toner (including a resin and a color material and also referred to as "dry developer") used in an electrophotographic image forming apparatus, 10 parts by mass or less of the color material (pigment) is included in 100 parts by mass of the resin. This ratio is determined by a relation of image density relative to a particle size of a toner particle (i.e., image film thickness). On the other hand, in a liquid developer (also referred to as "wet developer"), a toner particle has a particle size smaller than that of the dry toner. Hence, required image density cannot be secured unless a ratio of the color material is increased.

Of such liquid developers, for example, a black developer generally employs a carbon black as a pigment. In order to secure image density, approximately 15 parts by mass or more of the carbon black needs to be included relative to 100 parts by mass of the resin. This ratio of the carbon black generally differs depending on the particle size of the toner particle.

Recently, in order to achieve high image quality, prevention of strike-through, and low cost, a demand arises in decreasing an amount of liquid developer (toner particles) adhered onto a recording material. Accordingly, the film thickness of the image tends to be decreased. However, image density needs to be satisfied even under such a condition. Hence, it is necessary to increase the content of the pigment in the toner particle.

Meanwhile, when the content of the pigment is increased in the toner particle, the amount of resin (also referred to as "binder resin") is relatively decreased to result in decrease of fixing strength onto the recording material. In addition, such an increased content of the pigment in the toner particle results in deterioration of dispersion property of the pigment in the resin. This leads to deterioration of electric property (transferring property) of the toner particle.

Under such a circumstance, it has been proposed to use a specific dispersant so as to improve the dispersion property of the toner particle in the liquid developer (Japanese Laid-Open Patent Publication No. 2011-027845; Japanese Laid-Open Patent Publication No. 2011-043650), or it has been proposed to use a specific dispersant so as to improve the dispersion property of the pigment in the toner particle (Japanese Laid-Open Patent Publication No. 2001-159834).

SUMMARY OF THE INVENTION

Although each of the techniques proposed by the above-described patent publications is expected to provide improvement of the dispersion property of the toner particle to some extent, the image density and the fixing strength could not be sufficiently secured at the same time.

Under such a circumstance, the present invention has been made and has an object to provide a liquid developer, by which high image density and high fixing strength are secured at the same time.

The present inventor has diligently studied to solve the above-described problem, and has obtained the following knowledge: in order to secure high image density and high fixing strength at the same time, it is necessary to uniformly disperse a pigment in a toner particle at a high concentration. Based on this knowledge, the present inventor has attempted to disperse the pigment at a high concentration by means of an effect of a dispersant, but concluded that there is a limit in the effect of the dispersant. Accordingly, various analyses have been conducted on materials other than the dispersant and having an effect of dispersing a pigment. As a result, it has been found that in the case where a carbon black is employed as a pigment, other specific pigments have an excellent dispersing effect for the carbon black. Based on this knowledge, further research has been conducted, thereby completing the present invention.

That is, a liquid developer of the present invention includes a toner particle and an insulating liquid, the toner particle including a resin and a pigment, the resin including a polyester resin, the pigment including a first pigment, a second pigment, and a third pigment, the first pigment being a carbon black, 10 to 25 mass % of the first pigment being included in the toner particle, the second pigment being nigrosine, 3 to 15 mass % of the second pigment being included in the toner particle, the third pigment being at least one organic pigment selected from a group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, 5 to 20 mass % of the third pigment being included in the toner particle.

Here, 15 to 25 mass % of both the first pigment and the second pigment in total are preferably included in the toner particle. The carbon black is preferably acidic.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic conceptual diagram of an electrophotographic image forming apparatus.

DESCRIPTION OF THE PREFERRED EMBODIMENTS

The following describes an embodiment according to the present invention more in detail.

<Liquid Developer>

A liquid developer of the present embodiment at least includes toner particles and an insulating liquid, and the toner particles are dispersed in the insulating liquid. As long as the liquid developer includes these components, it may include any other components. Examples of the other components include: a toner dispersant (which is different from a below-described pigment dispersant included in each toner particle, is a dispersant included in the insulating liquid to disperse the toner particles, and is referred to as "toner dispersant" in the present embodiment for ease of description), a charge control agent, a thickener, and the like.

The liquid developer can include 1 to 50 mass % of the toner particles with the insulating liquid and the like being the remainder, for example. If less than 1 mass % of the toner particles are included, sedimentation of the toner particles is likely to take place, exhibiting tendency of decreasing stability with passage of time during long-term storage. Moreover, in order to achieve required image density, a large amount of the liquid developer needs to be supplied, with the result that an increased amount of the insulating liquid is adhered to a recording material such as paper. Accordingly, the insulating liquid needs to be dried during fixing and resultant steam may cause an environmental problem. On the other hand, if more than 50 mass % of the toner particles are included, viscosity of the liquid developer becomes too high, exhibiting tendency of providing difficulties in terms of production and handling.

Further, the liquid developer preferably has a viscosity of not less than 0.1 mPa·s and not more than 10000 mPa·s at 25° C. If the viscosity is more than 10000 mPa·s, it is difficult to stir the liquid developer, with the result that the toner particles cannot be dispersed uniformly in the insulating liquid. This may impose a large burden on an apparatus for obtaining the liquid developer. On the other hand, if the viscosity is less than 0.1 mPa·s, sedimentation of the toner particles is likely to take place to decrease stability with passage of time during long-term storage, thus possibly resulting in unstable image density.

Such a liquid developer is useful as a black developer for an electrophotographic image forming apparatus, secures image density and fixing strength at the same time, and also achieves high image quality, prevention of disturbed image during transferring, low cost, and the like.

<Toner Particles>

The toner particles included in the liquid developer of the present embodiment includes a resin and a pigment. As long as the toner particle includes the resin and the pigment, other arbitrary components may also be included. Examples of the other components include: a pigment dispersant, a wax, a charge control agent, another colorant (apart from a first pigment, a second pigment, and a third pigment), and the like.

Further, such toner particles preferably have a mean particle size of 0.1 to 5 μm, more preferably, 0.5 to 3 μm. It should be noted that the term "mean particle size" herein refers to a volume average particle size. The following describes each of the components included in such toner particles.

<Pigment>

The pigment included in the toner particle of the present embodiment includes a first pigment, a second pigment, and a third pigment, the first pigment being a carbon black, 10 to 25 mass % of the first pigment being included in the toner particle, the second pigment being nigrosine, 3 to 15 mass % of the second pigment being included in the toner particle, the third pigment being at least one organic pigment selected from a group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, 5 to 20 mass % of the third pigment being included in the toner particle.

Thus, in the present embodiment, the carbon black is employed as the first pigment, and is used together with the second pigment and the third pigment, thereby improving dispersion property of the first pigment in the toner particle. Accordingly, the pigment is dispersed uniformly in the toner particle at a high concentration, thereby securing image density and fixing strength at the same time.

Generally, if the content of a pigment is made high in the toner particle in order to increase image density, the ratio of the resin becomes relatively small, with the result that the fixing strength tends to be deteriorated. Although the improvement of the image density and the improvement of the fixing strength are in a trade-off relation, both the properties in the trade-off relation can be successfully made high in the liquid developer of the present embodiment.

Japanese Laid-Open Patent Publication No. 2011-027845 and Japanese Laid-Open Patent Publication No. 2011-043650 described above disclose in Examples that a carbon black and an organic pigment are used together and the carbon black and nigrosine are used together. However, these combinations do not provide sufficient dispersion property of the carbon black in the toner particle, thus resulting in decrease of the fixing strength. This is presumably due to the following reason. That is, the insufficient dispersion property of the pigment possibly causes occurrence of a region having accumulated pigment in a surface portion of the toner particle. This region leads to the decreased fixing strength. Meanwhile, even if nigrosine and the organic pigment are used together, sufficient image density superior to the carbon black cannot be secured.

In order to attain the improvement of the image density and the improvement of the fixing strength at the same time, it is considered effective to provide the toner particle with a high concentration of a carbon black, which is excellent in coloring power, with a good dispersion property. In the conventional techniques, it has been known to use two types of pigments together, but the use thereof is intended for fine adjustment of image density or adjustment of color shade. The conventional techniques do not provide any suggestion as to dispersion property such as improvement of dispersion property of one pigment by addition of another pigment. Specifically, in the conventional techniques, the dispersion property of a pigment in the toner particle depends only on an effect of the pigment dispersant. However, the pigment dispersant is not a colorant but a surfactant, so that there is a limit in improving the image density even when an increased amount of the pigment dispersant is added to improve the dispersion property of the pigment.

In the present embodiment, the three types of pigments are used together. The second pigment and the third pigment exert a dispersant-like effect to the carbon black serving as the first pigment, which contributes to the improvement of the image density the most, thereby highly improving the dispersion property of whole of the pigments. In this way, both image density and fixing strength can be secured at the same time. Thus, the liquid developer of the present embodiment can secure sufficient image density and sufficient fixing strength at the same time even when only a small amount, approximately 0.5 to 3.0 g/m$^2$, of the toner particles are adhered to the recording material.

Such pigments of the present embodiment is dispersed in the resin within the toner particle, and exhibits a desired black color tone. Further, the pigment has a particle size of not more than 0.5 μm, more preferably, not more than 0.15 μm. If the pigment has a particle size of more than 0.5 μm, the color value of the image is deviated, with the result that a desired color is not possibly attained. In addition, the dispersion property of the pigment becomes bad, with the result that desired image density cannot be possibly attained and the fixing strength possibly becomes deteriorated. It should be noted that the lower limit value of the particle size of the pigment is not particularly limited.

It should be noted that the term "pigment" in the present embodiment is not limited to a substance generally recognized as a pigment, but also can include a substance classified as a dye. More specifically, the term "pigment" refers to a substance having a solubility of 0 to 0.5 g at 25° C. relative to 100 g of the insulating liquid included in the liquid developer including the pigment. Meanwhile, the term "particle size of the pigment" described above is intended to indicate a volume average particle size thereof.

The following describes the pigments used in the present embodiment more in detail.

<First Pigment>

The first pigment is the carbon black, and is characterized in that 10 to 25 mass % of the first pigment is included in the toner particle. If the content of the carbon black is less than 10 mass %, required image density cannot be secured. If the content thereof is more than 25 mass %, the content of the resin in the toner particle becomes small to result in insufficient fixing strength. The content thereof is more preferably 10 to 20 mass %, further preferably, 10 to 15 mass %.

In the present embodiment, the carbon black can be included at a high concentration because not only the carbon black but also nigrosine serving as the second pigment and the organic pigment serving as the third pigment are added in the toner particle. This is a significant feature of the present embodiment.

Here, the "carbon black" is a generic term of black fine particles including carbon as a main component, and may be chemically classified as a simple substance of carbon, but can include various types of functional groups as known well. A type of such a carbon black is not particularly limited. Examples of the carbon black include thermal black, acetylene black, channel black, furnace black, lamp black, aniline black, and the like.

It should be noted that such a carbon black can be provided, as required, with surface treatment for modifying a property of the surface thereof. For example, surface treatment is preferably provided to render the surface of the carbon black acidic. In other words, such a carbon black is preferably acidic.

For the treatment method, various types of conventionally known methods can be employed. Preferable examples thereof include: a wet type surface treatment method for immersing a carbon black in an acidic solution such as an acetic acid solution or a sulfonic acid solution; and a dry type surface treatment method employing no liquid. Examples of the dry type surface treatment method include: a method of exposing the surface to a mixed gas of nitric acid or nitrogen oxide and air, or an oxidizing agent such as ozone; and an air oxidation method. Some carbon blacks already adjusted in pH are commercially available.

It should be noted that the term "acidic" described above is intended to indicate that a mud-like mixture obtained by boiling a mixture, which includes the carbon black and pure water at a ratio of 1:1, for 5 minutes and thereafter cooling it to a room temperature, has a pH of 6 or less. The pH is more preferably 5 or less.

Specific preferable examples of the above-described carbon black include: "#2400" (pH 2.0), "#2400B" (pH 2.5), "#2650" (pH 3.0), "OIL7B" (pH 3.0), "MA-77" (pH 2.8), "MA-100" (pH 3.0), "MA-100S" (pH 3.5), and "PCF#10" (pH 7.0) each provided by Mitsubishi Chemical Corporation; "Black Pearls L" (pH 2.5), "MOGUL-L" (pH 2.5), "MONARCH 1300" (pH 2.5), "MONARCH 1400" (pH 2.5), "REGAL 330R" (pH 8.5), "REGAL 400R" (pH 4.0), and "MONARCH 1100" (pH 7.0) each provided by Cabot Corporation; "Printex V" (pH 3.0), "Special Black 4" (pH 3.0), "Printex 140V" (pH 4.5) each provided by Degussa; and the like (the above-described words between the quotation marks represent trademarks).

<Second Pigment>

The second pigment is nigrosine, and is characterized in that 3 to 15 mass % of the second pigment is included in the toner particles. If the content of nigrosine is less than 3 mass %, the dispersion property of the carbon black serving as the first pigment becomes deteriorated, with the result that desired image density cannot be attained and the fixing strength is also decreased. If the content of nigrosine is more than 15 mass %, viscoelasticity of the toner particle becomes significantly high, with the result that fixing cannot be attained at a desired fixing temperature. A more preferable content thereof is 3 to 10 mass %.

Preferably, 15 to 25 mass %, more preferably, 20 to 25 mass % of both the first pigment and the second pigment in total are included in the toner particle. With the first pigment and the second pigment being included to fall within such a range, higher image density and higher fixing strength can be suitably secured at the same time.

Here, the term "nigrosine" refers to a mixture of various types of azine-based compounds that can be obtained through oxidation-reduction condensation of aniline, aniline hydrochloride, and nitrobenzene in presence of a catalyst such as iron chloride. The main component of nigrosine is an azine-based compound, which is a purple-black dye having a skeleton of phenazine, phenazineazine, triphenazineoxazine, or the like.

Examples of such nigrosine include: C.I. (Color Index) solvent black 7, C.I. solvent black 5, various types of azine-based compounds, and the like.

Examples of the C.I. solvent black 5 include products commercially available under trademarks such as "Spirit Black SB", "Spirit Black SSBB", "Spirit Black AB", "Spirit Black ABL", "NUBIAN BLACK NH-805", and "NUBIAN BLACK NH-815", each provided by Orient Chemical Industries, Ltd.

Examples of the C.I. solvent black 7 include products commercially available under trademarks such as "Nigrosine Base SA", "Nigrosine Base SAP", "Nigrosine Base SAPL", "Nigrosine Base EE", "Nigrosine Base EEL", "Nigrosine Base EX", "Nigrosine Base EXBP", "Special Black EB", "NUBIAN BLACK TN-870", "NUBIAN BLACK TN-877", "NUBIAN BLACK TH-807", "NUBIAN BLACK TH-827", and "NUBIAN GREY IR-B", each provided by Orient Chemical Industries, Ltd.

Examples of the azine-based compound include products commercially available under trademarks such as "BONTRON N-01", "BONTRON N-04", "BONTRON N-07", "BONTRON N-09", "BONTRON N-21", "BONTRON N-71", "BONTRON N-75", and "BONTRON N-79", each provided by Orient Chemical Industries, Ltd.

<Third Pigment>

The third pigment is at least one organic pigment selected from a group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, and is characterized in that 5 to 20 mass % of the third pigment is included in the toner particles. If the content of the third pigment is less than 5 mass %, the dispersion properties of the first pigment (carbon black) and the second pigment (nigrosine) are decreased, with the result that desired image density cannot be attained and fixing strength becomes deteriorated. If the content of the third pigment is more than 20 mass %, a ratio of the resin in the toner particle becomes small, with the result that required fixing strength cannot be attained and deviation in hue becomes large, unfavorably. A more preferable content thereof is 5 to 15 mass %.

It is assumed that in the case where two or more types of pigments are included as the third pigment, the content of the third pigment represents a content of total of the two or more types of pigments.

Such a third pigment is composed of at least one organic pigment selected from the group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, but a conventionally known pigment can be used without any particular limitation as long as it is included in these types.

Here, the phthalocyanine blue pigment is a blue organic pigment having a phthalocyanine skeleton such as copper phthalocyanine. Examples thereof include: C.I. Pigment Blue 15:1; C.I. Pigment Blue 15:2; C.I. Pigment Blue 15:3; C.I. Pigment Blue 15:4; and the like.

The phthalocyanine green pigment is a green organic pigment having a phthalocyanine skeleton such as highly chlorinated copper phthalocyanine. Examples thereof include C.I. Pigment Green 7, C.I. Pigment Green 36, and the like.

The carmine-based pigment is a red organic pigment classified as the "carmine-based pigment". Examples thereof include C.I. Pigment Red 48:1; C.I. Pigment Red 53:1; C.I. Pigment Red 57:1; and the like.

The naphthol-based pigment is a red organic pigment classified as "naphthol-based pigment". Examples thereof include: C.I. Pigment Red 5; C.I. Pigment Red 269; C.I. Pigment Red 150; C.I. Pigment Red 184; and the like.

The quinacridon-based pigment is a red to purple organic pigment having a quinacridone skeleton. Examples thereof include: C.I. Pigment Red 122; C.I. Pigment Red 209; and the like.

The azo-based pigment is a yellow to orange organic pigment classified as "azo-based pigment", such as an insoluble azo-based pigment or a condensed azo-based pigment. Examples thereof include: C.I. Pigment Yellow 74; C.I. Pigment Yellow 94; C.I. Pigment Yellow 155; and the like.

The benzimidazolone-based pigment is a yellow to orange organic pigment classified as "benzimidazolone-based pigment". Examples thereof include C.I. Pigment Yellow 180, and the like.

The isoindoline-based pigment is a yellow to orange organic pigment classified as "isoindoline-based pigment". Examples thereof include C.I. Pigment Yellow 185, and the like.

<Resin>

The resin included in the toner particles of the present embodiment includes a polyester resin. Accordingly, properties of the toner particle such as a heat property can be changed in a wide range, and the toner particle can be excellent in light transmitting property, extensibility, and viscoelasticity. Because the polyester resin is thus excellent in light transmitting property, a beautiful coloration can be attained when obtaining a color image. Because the polyester resin is also excellent in extensibility and viscoelasticity, an image (resin film) formed on a recording material such as paper is tough and can be strongly adhered to the recording material.

Such a polyester resin preferably has a number average molecular weight (Mn) of not less than 500 and not more than 5000, more preferably, not less than 500 and not more than 3500. If the number average molecular weight is less than 500, uniform dispersion of the pigments therewith may be less likely to be attained. On the other hand, if the number average molecular weight is more than 5000, energy required during fixing onto the recording material may become unfavorably large. It should be noted that the number average molecular weight can be measured by means of GPC (Gel Permeation Chromatography).

Further, such a polyester resin exhibits thermoplasticity, and preferably has a glass transition point (Tg) of not less than 60° C. and not more than 85° C. If the glass transition point is less than 60° C., storage stability may become deteriorated. If the glass transition point is more than 85° C., energy for fixing an image is significantly increased, which is economically disadvantageous and which is likely to provide thermal damage on each unit of the image forming apparatus. If the glass transition point is more than 85° C. and the fixing temperature is low, luster of the image may be decreased. A more preferable glass transition point is not less than 60° C. and not more than 75° C.

Such a polyester resin can be obtained by an ordinary method, i.e., by polycondensation of a polyvalent alcohol and a polybasic acid (typically, polyvalent carboxylic acid).

Here, examples of the polyvalent alcohol include, but not particularly limited to: alkylene glycols (aliphatic glycols), such as ethylene glycol, diethylene glycol, triethylene glycol, propylene glycol such as 1,2-propylene glycol, dipropylene glycol, butanediol such as 1,4-butanediol, neopentyl glycol, and hexanediol such as 1,6-hexanediol, and the alkylene glycols with alkylene oxide adducts; phenol-based glycols, such as bisphenols such as bisphenol A and hydrogenated bisphenol, and the bisphenols with alkylene oxide adducts; alicyclic and aromatic diols such as monocyclic or polycyclic diol; and triols such as glycerin and trimethylolpropane. They can be used solely or two or more of them may be mixed and used. In particular, bisphenol A with 2 to 3 mol of alkylene oxide adduct is suitable as the resin for the toner particle of the liquid developer in terms of solubility and stability of the polyester resin, which is a resulting product. Bisphenol A with 2 to 3 mol of alkylene oxide adduct is also preferable due to low cost. Examples of the alkylene oxide include ethylene oxide, propylene oxide, and the like.

Further, examples of the polybasic acid (polyvalent carboxylic acid) include: saturated or unsaturated (or aromatic) divalent basic acids, such as malonic acid, succinic acid, adipic acid, azelaic acid, sebacic acid, fumaric acid, maleic acid, itaconic acid, phthalic acid, a modified acid thereof (for example, hexahydro phthalic anhydride), isophthalic acid, and terephthalic acid, as well as acid anhydrides and lower alkyl esters thereof; and trivalent basic acids such as trimellitic acid, trimesic acid, pyromellitic acid, and methylnadic acid, as well as acid anhydrides and lower alkyl esters thereof. They can be used solely or two or more of them can be mixed and used.

Among these, the isophthalic acid, the terephthalic acid, and the trimellitic acid are suitable as the resin for the toner particle of the liquid developer in terms of solubility and stability of the polyester resin, which is a resulting product. Moreover, they are preferable due to low cost.

It should be noted that as the resin of the present embodiment, a resin having a core shell type structure can be also used.

<Pigment Dispersant>

The toner particle of the present embodiment can include a pigment dispersant to uniformly disperse the pigments. As described above, in the present embodiment, the dispersion property of the first pigment is improved by using the second pigment and the third pigment together, but addition of the pigment dispersant can ensure uniform dispersion properties of the pigments.

As such a pigment dispersant, a basic pigment dispersant is preferably used to more stably attain uniform dispersion of the pigments in the toner particle. A type of the pigment dispersant is not limited as long as it is such a basic pigment dispersant.

Here, the term "basic pigment dispersant" is defined as follows. That is, the pigment dispersant is defined as being basic when 0.5 g of the pigment dispersant and 20 ml of distilled water are introduced into a screw pipe made of glass, are then shaken using a paint shaker for 30 minutes, are then filtered, and a resultant filtrate has a pH of more than 7, which is measured using a pH meter (trademark: "D-51" provided by Horiba, Ltd). It should be noted that when the pH thereof is less than 7, the pigment dispersant is called "acidic pigment dispersant".

A type of such a basic pigment dispersant is not particularly limited. Examples thereof include a compound (dispersant) having a functional group in its molecular, such as amine group, amino group, amide group, pyrrolidone group, imine group, imino group, urethane group, quaternary ammonium group, ammonium group, pyridino group, pyridium group, imidazolino group, and imidazolium group. It should be noted that the term "dispersant" normally represents a surfactant having a hydrophilic portion and a hydrophobic portion in its molecular, but various types of compounds can be used therefor as long as they have an effect of dispersing a pigment.

Examples of commercially available products of such a basic pigment dispersant include: "AJISPER PB-821" (trademark), "AJISPER PB-822" (trademark), and "AJISPER PB-881" (trademark), each provided by Ajinomoto Fine-Techno Co., Inc; and "Solsperse 28000" (trademark), "Solsperse 32000" (trademark), "Solsperse 32500" (trademark), "Solsperse 35100" (trademark), and "Solsperse 37500" (trademark), each provided by Lubrizol Japan Limited.

An amount of addition of such a pigment dispersant is preferably 1 to 100 mass % relative to the pigments. More preferably, the amount thereof is 1 to 40 mass %. If the amount thereof is less than 1 mass %, the dispersion property of the pigments may become insufficient, with the result that required ID (image density) cannot be attained and the fixing strength may be decreased. On the other hand, if the amount is more than 100 mass %, a required amount or more of the pigment dispersant is added for pigment dispersion, with the result that an excess amount of the pigment dispersant may be dissolved in the insulating liquid, thereby possibly providing an adverse effect on charged form and fixing strength of the toner particle.

The pigment dispersants thus listed above can be used solely or two or more of them may be used in combination.

<Insulating Liquid>

The insulating liquid included in the liquid developer of the present embodiment preferably has a resistance value (approximately $10^{11}$ to $10^{16}$ Ω·cm) not to disturb an electrostatic latent image. In addition, the insulating liquid preferably has no odor and no toxicity.

Examples of such an insulating liquid include aliphatic hydrocarbon, cycloaliphatic hydrocarbon, aromatic hydrocarbon, halogenated hydrocarbon, polysiloxane, and the like. Particularly, in view of odor, non-toxicity, and cost, it is preferable to use a normal paraffin-based solvent or an isoparaffin-based solvent. Specific examples thereof include MORESCO WHITE (trademark; provided by MORESCO Corporation), Isopar (trademark; provided by Exxon Chemical Company), Shellsol (trademark; provided by Shell Chemicals), IP Solvent 1620 and IP Solvent 2028 (trademarks; provided by Idemitsu Chemicals), and the like.

<Toner Dispersant>

The liquid developer of the present embodiment can include a dispersant (toner dispersant) soluble in the insulating liquid so as to stably disperse the toner particles in the insulating liquid. A type of such a toner dispersant is not particularly limited as long as it stably disperses the toner particles. When the polyester resin used as the resin included in the toner particle has a relatively high acid value, it is preferable to use a basic polymer dispersant.

Such a toner dispersant may be dissolved in the insulating liquid or may be dispersed therein. Further, such a toner dispersant is preferably added in a range of 0.5 to 20 mass % relative to the toner particles. If the amount of addition is less than 0.5 mass %, the dispersion property is decreased. If the amount of addition is more than 20 mass %, the toner dispersant captures the insulating liquid, thereby possibly decreasing the fixing strength of the toner particle.

It should be noted that when such a toner dispersant is adsorbed to the surface of a toner particle, the toner dispersant is regarded as a part of the toner particle and is added to the mass of the toner particle.

<Production Method>

The liquid developer of the present embodiment can be produced based on, for example, a conventionally known method such as a granulation method or a pulverization method, and the production method is not particularly limited. However, the granulation method is one of the most suitable production methods because the granulation method is more excellent in energy efficiency and has fewer numbers of steps than the pulverization method. Such a granulation method is a suitable production method also in view of such a fact that toner particles having small sizes and uniform particle size distribution can be readily obtained.

More specifically, examples of the granulation method include a suspension polymerization method, an emulsion polymerization method, a particle coagulation method, a method that adds a poor solvent to a resin solution and precipitates the resin, a spray drying method, and the like. Examples of the polymerization method include a method in which water or a similar liquid is used as a continuous phase and, after toner particles are prepared, the liquid is replaced with oil (insulating liquid), or a method in which polymerization is performed directly in the oil (insulating liquid).

EXAMPLES

In the following, the present invention will be described more in detail in connection with Examples. The present invention, however, is not limited to them. It should be noted that the term "parts" in the Examples means "parts by mass" unless otherwise noted.

<Synthesis of Polyester Resin 1>

As raw material monomers, 750 parts of bisphenol A with propylene oxide adduct (polyvalent alcohol expressed by Formula (I) below), 300 parts of terephthalic acid (polybasic acid), and 20 parts of trimellitic acid (polybasic acid) were introduced into a four-neck flask having a stirring rod, a partial condenser, a nitrogen gas introduction pipe, and a thermometer. Nitrogen gas was introduced thereto while stirring them so as to perform polycondensation at a temperature of approximately 170° C.

(I)

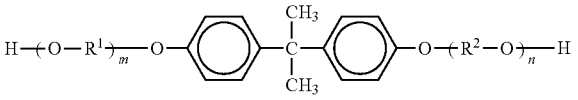

In Formula (I), each of m and n was 0 or a positive integer, and a total of them was 1 to 16. $R^1$ and $R^2$ independently represent alkylene groups having a carbon number of 2 or 3 (it should be noted that $R^1$ and $R^2$ never became an alkylene group having a carbon number of 2 at the same time).

Then, when the number average molecular weight (Mn) became approximately 3000, the temperature was lowered to approximately 100° C., and 0.012 parts of hydroquinone was added as a polymerization inhibitor to stop the polycondensation and thereby obtain a polyester resin. The polyester resin obtained in this way was named "polyester resin 1". The number average molecular weight (Mn) of this "polyester resin 1" was measured to be 3500, the acid value thereof was 20.6 mgKOH/g, and the glass transition point (Tg) thereof was 66° C.

<Synthesis of Polyester Resin 2>

A "polyester resin 2" was obtained in the same manner as in the synthesis method of polyester resin 1 except that 320 parts of terephthalic acid was used, 60 parts of trimellitic acid was used, and the number average molecular weight (Mn) was set to be approximately 2800 when the temperature was lowered to approximately 100° C. The number average molecular weight of "polyester resin 2" obtained was measured to be 2900, the acid value thereof was 42.3 mgKOH/g, and the glass transition point (Tg) thereof was 68° C.

Example 1

400 parts of glass beads were added relative to 400 parts of acetone, 56.5 parts of polyester resin 1 serving as the resin included in the toner particle, 12 parts of carbon black (trademark: "Mogul L" provided by Cabot Corporation) serving as the first pigment, 8 parts of nigrosine (trademark: "TH-827" provided by Orient Chemical Industries, Ltd) serving as the second pigment, 5 parts of phthalocyanine blue pigment (trademark: "Fastogen Blue GNPT" provided by DIC Corporation), 5 parts of carmine-based pigment (trademark: "SYMULER Brilliant Carmine 6B 226" provided by DIC Corporation), 5 parts of benzimidazolone-based pigment (trademark: "Toner Yellow HG" provided by Clariant Japan) each of which serves as the third pigment, and 3.5 parts of pigment dispersant (trademark: "AJISPER PB-821" provided by Ajinomoto Fine-Techno Co., Inc). They were dispersed for 3 hours using a paint conditioner, and then the glass beads were removed, thereby producing a resin solution X having the pigments dispersed therein.

Next, a solution in which 5 parts of N-vinyl pyrrolidone/alkylene copolymer (trademark: "Antaron V-216" provided by GAF/ISP Chemicals) as the toner dispersant was dissolved in 300 parts of an insulating liquid (trademark: "IP Solvent 2028" provided by Idemitsu Chemicals) was added to resin solution X. Then, a homogenizer is operated to disperse them for 5 minutes, thereby preparing a liquid developer precursor.

Next, an evaporator was used to remove acetone from the liquid developer precursor, which was then held for 4 hours in a thermostatic chamber of 50° C. In this way, the liquid developer of the present invention was prepared which includes the toner particles and the insulating liquid. The toner particles (each having a surface having the toner dispersant adsorbed thereto) included the resin (polyester resin 1), the first pigment (12 mass %), the second pigment (8 mass %), and the third pigment (each 5 mass %), and had a mean particle size of 2.1 μm.

It should be noted that the volume average particle size of the toner particles was measured using a particle size distribution measuring apparatus (trademark: "SALD-2200" provided by Shimadzu Corporation) (the same applies to the description below).

Examples 2 to 7 and Comparative Examples 1 to 11

Liquid developers were prepared in the same manner as in Example 1, except that materials described in Table 1 below were used as the resin, the first pigment, the second pigment, and the third pigment and the resin and the pigment dispersant were added by amounts described in Table 1.

TABLE 1

| | Resin | Pigment Dispersant | First Pigment | Second Pigment | Third Pigment | | |
|---|---|---|---|---|---|---|---|
| Example 1 | PES1 (56.5) | 3.5 | CB1 (12) | NS1 (8) | C1 (5) | M1 (5) | Y1 (5) |
| Example 2 | PES1 (44.4) | 4.6 | CB1 (25) | NS2 (3) | C1 (3) | M2 (3) | Y2 (12) |
| Example 3 | PES1 (48.8) | 4.2 | CB2 (10) | NS1 (15) | C1 (6) | M3 (4) | Y1 (7) |
| Example 4 | PES2 (75.2) | 1.8 | CB2 (10) | NS1 (3) | C1 (5) | — | — |
| Example 5 | PES2 (29.0) | 6.0 | CB1 (25) | NS1 (15) | — | M3 (5) | Y3 (15) |
| Example 6 | PES1 (45.5) | 4.5 | CB1 (25) | NS1 (15) | C2 (2) | M2 (3) | — |
| Example 7 | PES1 (56.5) | 3.5 | CB3 (12) | NS1 (8) | C1 (5) | M1 (5) | Y1 (5) |
| Example 8 | PES1 (56.5) | 3.5 | CB1 (12) | NS1 (8) | C1 (5) | M1 (5) | Y1 (5) |
| Comparative Example 1 | PES1 (73.0) | 2.0 | CB1 (17.5) | — | C1 (2.5) | — | — |
| Comparative Example 2 | PES1 (73.0) | 2.0 | CB1 (15) | NS1 (5) | — | — | — |
| Comparative Example 3 | PES1 (75.9) | 1.7 | CB1 (15.6) | NS2 (1.8) | — | — | — |
| Comparative Example 4 | PES1 (51.0) | 4.0 | CB1 (25) | NS1 (15) | — | — | — |
| Comparative Example 5 | PES1 (45.5) | 4.5 | CB1 (25) | — | — | M3 (5) | Y3 (15) |
| Comparative Example 6 | PES1 (38.9) | 5.1 | CB1 (30) | NS2 (3) | C1 (3) | M2 (3) | Y2 (12) |
| Comparative Example 7 | PES1 (43.3) | 4.7 | CB1 (10) | NS1 (20) | C1 (6) | M3 (4) | Y1 (7) |
| Comparative Example 8 | PES1 (49.9) | 4.1 | CB2 (9) | NS1 (15) | C1 (6) | M3 (4) | Y1 (7) |

TABLE 1-continued

| | Resin | Pigment Dispersant | First Pigment | Second Pigment | Third Pigment | | |
|---|---|---|---|---|---|---|---|
| Comparative Example 9 | PES1 (45.5) | 4.5 | CB1 (25) | NS2 (2) | C1 (3) | M2 (3) | Y2 (12) |
| Comparative Example 10 | PES1 (57.6) | 3.4 | CB2 (10) | NS1 (3) | C1 (7) | M1 (6) | Y1 (8) |
| Comparative Example 11 | PES1 (76.3) | 1.7 | CB2 (10) | NS1 (3) | C1 (1) | M1 (2) | Y1 (1) |

Numerals in parentheses and numerals in the column of Pigment Dispersant represent "mass %" in the toner particle.

In Table 1, various designations represent the following:

PES1: polyester resin 1

PES2: polyester resin 2

CB1: "Mogul L" (trademark) provided by Cabot Corporation

CB2: "MA77" (trademark) provided by Mitsubishi Chemical Corporation

CB3: "Regal 330R" (trademark) provided by Cabot Corporation

NS1: "TH-827" (trademark) provided by Orient Chemical Industries, Ltd

NS2: "BONTRON N-09" provided by Orient Chemical Industries, Ltd

C1: phthalocyanine blue pigment (C.I. Pigment Blue 15:3; trademark: "Fastogen Blue GNPT" provided by DIC Corporation)

C2: phthalocyanine green pigment (C.I. Pigment Green 7; trademark: "Fastogen Green S" provided by DIC Corporation)

M1: carmine-based pigment (C.I. Pigment Red 57:1; trademark: "SYMULER Brilliant Carmine 6B 226" provided by DIC Corporation)

M2: quinacridon-based pigment (C.I. Pigment Red 122; trademark: "Fastogen Super Magenta RTS" provided by DIC Corporation)

M3: naphthol-based pigment (C.I. Pigment Red 269; trademark: "Toshiki Red 1022" provided by DIC Corporation)

Y1: benzimidazolone-based pigment (C.I. Pigment Yellow 180; trademark: "Toner Yellow HG" provided by Clariant Japan)

Y2: isoindoline-based pigment (C.I. Pigment Yellow 185; trademark: "PALIOTOL YELLOW D 1155" provided by BASF)

Y3: azo-based pigment (C.I. Pigment Yellow 74; trademark: "SEIKAFAST YELLOW 2054" provided by Dainichiseika Color & Chemicals Mfg. Co., Ltd)

In Table 1, blank ("-") indicates that a corresponding substance is not included.

Example 8

12 parts of carbon black (trademark: "Mogul L" provided by Cabot Corporation) serving as the first pigment, 8 parts of nigrosine (trademark: "TH-827" provided by Orient Chemical Industries, Ltd) serving as the second pigment, 5 parts of phthalocyanine blue pigment (trademark: "Fastogen Blue GNPT" provided by DIC Corporation), 5 parts of carmine-based pigment (trademark: "SYMULER Brilliant Carmine 6B 226" provided by DIC Corporation), 5 parts of benzimidazolone-based pigment (trademark: "Toner Yellow HG" provided by Clariant Japan) each of which serves as the third pigment, and 3.5 parts of the same pigment dispersant as that in Example 1 were added relative to 56.5 parts of polyester resin 1 serving as the resin included in the toner particle. Then, they were sufficiently mixed using a Henschel mixer, and were then melted and kneaded using an extruder having twin screws rotating in the same direction, at a heating temperature of 100° C. within a roll. Then, the resultant mixture was cooled and was roughly pulverized, thereby obtaining roughly pulverized toner Y.

Then, this roughly pulverized toner Y was pulverized using a counter jet mill 200AFG (provided by Hosokawa Micron), thereby obtaining toner particles Y. Toner particles Y had a mean particle size of 2.4 μm.

Then, 300 parts of insulating liquid (trademark: "IP Solvent 2028" provided by Idemitsu Chemicals), 95 parts of toner particles Y, and 5 parts of N-vinyl pyrrolidone/alkylene copolymer (trademark: "Antaron V-216" provided by GAF/ISP Chemicals) were mixed with one another, and were dispersed for 2 hours using a paint shaker. In this way, the liquid developer of the present invention was prepared which included the toner particles and the insulating liquid. The toner particles include the resin (polyester resin 1), the first pigment (12 mass %), the second pigment (8 mass %), and the third pigment (each 5 mass %), and had a mean particle size of 2.4 μm.

<Evaluation>

<Measuring Method for Molecular Weight>

The number average molecular weight (Mn) of the polyester resin was measured by means of GPC (Gel Permeation Chromatography). The measurement was performed under the following conditions.

DETECTOR: RI (refractive index) detector

COLUMN: Shodex KF-404HQ (trademark; provided by Showa Denko)+Shodex KF-402HQ (trademark; provided by Showa Denko)

Solvent: tetrahydrofuran

Flow rate: 0.4 ml/min.

Calibration curve: standard polystyrene

<Measurement of Acid Value>

The acid value of the polyester resin was measured under conditions defined in JIS K5400.

<Measurement of Glass Transition Point>

The glass transition point (Tg) of the polyester resin was measured using a differential scanning calorimeter "DSC-6200" (provided by Seiko Instruments), under conditions that an amount of sample was 20 mg and a temperature increasing rate was 10° C./min.

<Evaluation of Image Density>

Using the image forming apparatus shown in FIG. 1, a monochrome solid (all one color) pattern (10 cm×10 cm; amount of adhered toner particles: 1.0 g/m$^2$) of each of the liquid developers of Examples 1 to 8 and Comparative Examples 1 to 11 was formed on a recording material (coated paper). Thereafter, fixing was performed using a heating roller (170° C.×nip time of 40 msec.).

Thereafter, the image densities of black solid portions of the resultant fixed images were measured using a reflection densitometer "X-Rite model 404" (trademark; provided by X-Rite), and were evaluated by ranking with the following three levels:

A: Image density of not less than 1.8

B: Image density of not less than 1.6 and less than 1.8

C: Image density of less than 1.6

It is indicated that as the numerical value of the image density was higher, the image density was higher. Results are shown in Table 2.

<Evaluation of Fixing Strength>

Using the image forming apparatus shown in FIG. 1, a monochrome solid (all one color) pattern (10 cm×10 cm; amount of adhered toner particles: 1.0 g/m$^2$) of each of the liquid developers of Examples 1 to 8 and Comparative Examples 1 to 11 was formed on a recording material (coated paper). Thereafter, fixing was performed using a heating roller (170° C.×nip time of 40 msec.).

Thereafter, portions with no offset were rubbed twice by an eraser (trademark: Sunakeshi "LION 26111" provided by LION OFFICE PRODUCTS CORP) with a pressing load of 1 kgf, and a remaining ratio of the image density was measured using a reflection densitometer "X-Rite model 404" (trademark; provided by X-Rite) and was evaluated by ranking with the following three levels:

A: The remaining ratio of the image density was not less than 90%.

B: The remaining ratio of the image density was not less than 80% and less than 90%.

C: The remaining ratio of the image density was less than 80%.

It is indicated that as the remaining ratio of the image density was higher, the fixing strength of the image was larger. Results are shown in Table 2.

It should be noted that process conditions and an outline of the process of the image forming apparatus are as follows.

<Process Conditions>

System velocity: 45 cm/s

Photoconductor: negatively charged OPC

Charging potential: −650V

Development voltage (voltage applied to developing roller): −420 V

Primary transfer voltage (voltage applied to transfer roller): +600 V

Secondary transfer voltage: +1200V

Pre-development corona CHG: appropriately adjusted in a range of −3 to 5 kV of voltage applied to needle <Outline of Process>

FIG. 1 is a schematic conceptual diagram of an electrophotographic image forming apparatus 1. First, a liquid developer 2 is scraped by a restriction blade 4 to form a thin layer of liquid developer 2 on a developing roller 3. Thereafter, toner particles are moved by nipping between developing roller 3 and a photoconductor 5, thereby forming a toner image on photoconductor 5.

Then, the toner particles are moved by nipping between photoconductor 5 and an intermediate transfer member 6, thereby forming a toner image on intermediate transfer member 6. Then, toners are placed on each other on intermediate transfer member 6, and an image is formed on recording material 10. Then, the image on recording material 10 is fixed by heating roller 11.

It should be noted that image forming apparatus 1 also includes a cleaning blade 7, a charging device 8, and a backup roller 9 in addition to the above-described components.

TABLE 2

| | Image Density | Fixing Strength |
|---|---|---|
| Example 1 | A | A |
| Example 2 | A | B |
| Example 3 | A | A |
| Example 4 | B | A |
| Example 5 | A | B |
| Example 6 | A | B |
| Example 7 | A | B |
| Example 8 | A | B |
| Comparative Example 1 | C | C |
| Comparative Example 2 | C | C |
| Comparative Example 3 | C | C |
| Comparative Example 4 | A | C |
| Comparative Example 5 | B | C |
| Comparative Example 6 | A | C |
| Comparative Example 7 | A | C |
| Comparative Example 8 | C | A |
| Comparative Example 9 | A | C |
| Comparative Example 10 | B | C |
| Comparative Example 11 | C | C |

As apparent from Table 2, the liquid developers of the Examples have been confirmed as securing high image density and high fixing strength as compared with the liquid developers of the Comparative Examples.

Heretofore, the embodiments and examples of the present invention have been illustrated, but it has been initially expected to appropriately combine configurations of the embodiments and examples.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer comprising a toner particle and an insulating liquid, said toner particle including a resin and a pigment, said resin including a polyester resin, said pigment including a first pigment, a second pigment, and a third pigment, said first pigment being a carbon black, 10 to 25 mass % of said first pigment being included in said toner particle, said second pigment being a nigrosine, 3 to 15 mass % of said second pigment being included in said toner particle, said third pigment being at least one organic pigment selected from the group consisting of a phthalocyanine blue pigment, a phthalocyanine green pigment, a carmine-based pigment, a naphthol-based pigment, a quinacridon-based pigment, an azo-based pigment, a benzimidazolone-based pigment, and an isoindoline-based pigment, 5 to 20 mass % of said third pigment being included in said toner particle.

2. The liquid developer according to claim 1, wherein 15 to 25 mass % of both said first pigment and said second pigment in total are included in said toner particle.

3. The liquid developer according to claim 1, wherein said carbon black is acidic.

4. The liquid developer according to claim 1, wherein said polyester resin is a polycondensation product of a polyvalent alcohol and a polybasic acid.

5. The liquid developer according to claim 1, wherein 10 to 15 mass % of said first pigment is included in said toner particle.

6. The liquid developer according to claim 1, wherein said toner particle has a mean particle size of 0.5 to 3 μm.

7. The liquid developer according to claim 1, wherein said toner particle further comprises a pigment dispersant.

8. The liquid developer according to claim 7, wherein said pigment dispersant is a basic pigment dispersant.

9. The liquid developer according to claim 1, wherein 20 to 25 mass % of both said first pigment and said second pigment in total are included in said toner particle.

* * * * *